United States Patent [19]

Schneider

[11] 3,991,246

[45] Nov. 9, 1976

[54] WEB OF WOVEN FABRIC FOR THE PRODUCTION OF REINFORCING INLAYS FOR ITEMS OF CLOTHING

[75] Inventor: Heinz Schneider, Gauting, Germany

[73] Assignee: Kufner Textilwerke KG, Munich, Germany

[22] Filed: Dec. 27, 1972

[21] Appl. No.: 318,918

[30] Foreign Application Priority Data

Dec. 29, 1971 Germany ..... 7149292[U]

[52] U.S. Cl. ..... 428/195; 2/272; 139/407; 139/383 R; 428/193; 428/257

[51] Int. Cl.[2] ..... D03D 23/00; D03D 25/00

[58] Field of Search ..... 161/90, 91, 146, 148, 161/167; 139/383 R, 407, 427; 2/272; 428/193, 194, 257, 195

[56] References Cited

UNITED STATES PATENTS

| | | | |
|---|---|---|---|
| 1,772,458 | 8/1930 | Diamond | 161/90 |
| 1,895,689 | 1/1933 | Schlegel | 161/90 |
| 1,976,669 | 10/1934 | Kranefuss | 139/407 |
| 2,269,321 | 1/1942 | Scheuer | 161/90 |
| 2,269,797 | 1/1942 | Swan et al. | 161/91 |
| 2,417,319 | 3/1947 | Nutter | 139/427 |
| 2,864,151 | 12/1958 | Bihaly | 161/91 |
| 3,442,736 | 5/1969 | Duns | 161/148 |
| 3,446,658 | 5/1969 | Rose et al. | 161/91 |

*Primary Examiner*—James J. Bell
*Attorney, Agent, or Firm*—Hill, Gross, Simpson, Van Santen, Steadman, Chiara & Simpson

[57] ABSTRACT

An additional, special warp thread system is woven into a web of woven material having a weft thread system and a warp thread system, the warp threads being arranged to have differing density in certain areas of the web for the purpose of increasing the structural rigidity. The additional warp thread system lies symmetrically with respect to the other warp thread system.

5 Claims, 7 Drawing Figures

WEB OF WOVEN FABRIC FOR THE PRODUCTION OF REINFORCING INLAYS FOR ITEMS OF CLOTHING

The invention relates to a web of woven fabric material in the form of a weft thread system and a warp thread system, for producing reinforcing inlays for items of clothing, the density of the warp threads being arranged to differ in specific portions of the web for the purpose of increasing the structural rigidity (stiffness) and elasticity (resilience) of the woven fabric. Webs of fabric material have already been proposed in which multi-weft and multi-warp reinforcing portions follow one another in the direction of the warp, these reinforcing regions having two webs of woven fabric, which lie one above the other and which are loosely attached to one another. These webs of woven fabric are distinguished, in comparison with the first-mentioned fabric webs which have differing density of warp thread, by their improved "handle" (feel), and these webs may have a good elasticity graduation. It is a time-consuming matter to stamp or cut the reinforcing inlays from the web of woven fabric because it is difficult — when finishing webs of woven fabric which are made in this manner — to arrange for the reinforcing repeats, which alternate with one another in the warp direction, to follow one another at exactly the same distance. It is necessary to provide this exact spacing between the successive reinforcing repeats for the purpose of ensuring that these regions will be exactly folded on to each other when the web is being stacked. Moreover, passage of heat is obstructed — when the inlay webs or strips, which are preferably intended for use as fixing material, are being attached — through the double layer of woven fabric or through the double layer of woven fabric or through the relatively bulky web present in the reinforcing regions. Thus, disparities will occur in the mutual adhesion of face material and inlay.

According to the invention in certain areas of the web, at least one additional, special warp thread system is woven into the weft thread system, this additional warp thread system lying symmetrically of the other warp thread system. In this way there is obtained a web of woven material which is symmetrical in respect of its centre plane, a similar weave being present on both sides of the web. This web of woven fabric can be drawn into the form of a stack, on a folding table, as easily as a web without reinforcing areas. The reinforcing areas, extending parallel to the lengthwise direction of the web, will always be automatically folded on to one another with precision, so that absolutely identical inlays may be stamped or cut out of the stack formed.

By reason of its symmetrical mode of construction, a web of woven fabric produced according to the invention will have a uniform shrinkage behavior, and will thus present favorable conditions for reinforcing inlays which are sealed on to the facing material of items of clothing. Owing to the fact that the weave of the thread systems is relatively compact (non-bulky), good conditions of heat flowthrough will be realized when the reinforcing inlays, cut out of the web of woven fabric, are being sealed onto facing materials of the items of clothing to be manufactured, this flowthrough of heat being similar to that which can be realized in the case of reinforcing inlays made of a web of woven fabric which is not reinforced.

In an embodiment of the web of woven fabric, in which the latter only contains one additional warp thread system, one of the warp thread systems has a 1 to 3 twill weave, while the other warp thread system has a 3 to 1 twill weave. However, a 1 to 4 twill weave and a 4 to 1 twill weave may equally well be woven. When two additional warp thread systems are used, it will be found satisfactory if one warp thread system has 1 to 3 or 1 to 4 twill weave, the other warp thread system has a 3 to 1 or 4 to 1 twill weave, and if the third warp thread system has a 2 to 2 twill weave; under these conditions a symmetrical web structure will, once again, be obtained and this web will be of a compact and non-bulky nature.

The inlays, cut out of the web of fabric material proposed according to the invention, will give the item of clothing being manufactured an excellent graduation (from the point of view of textile handle or feel) of the reinforcing effect. At the same time any differences in the degree of adhesion will be relatively unimportant, if these inlays are attached, to the facing material of the item of clothing being manufactured, by thermal welding entailing the use of a coating of thermoplastic adhesion, which coating is applied on one side of the inlay. The provision of two additional warp thread systems is mainly applicable in those areas of the web from which the shoulder portions of the reinforcing inlays are cut or stamped. Instead of using two additional warp thread systems in these areas of the web of woven fabric, it will also be possible to use only one additional warp thread system, which will be made of a warp material having a specially high degree of springiness or elasticity, so that the particularly strong reinforcing effect, required in this region, may be attained.

The web of woven fabric has, preferably, a width which is at least great enough to enable the reinforcing inlay to be cut out of the web transversely of the longitudinal direction of extent of the latter. It will be found to be particularly satisfactory if the web of woven fabric has a width such that pairs of reinforcing inlays — the two inlays of each pair lying one beside the other, transversely of the longitudinal direction of the web — can be cut out of the web. Under these circumstances the web of woven fabric is, conveniently, so arranged that the special, additional warp thread systems lie at the two longitudinal edges of the web of woven fabric. However, these special, additional warp thread systems may also lie, one beside the other, in the centre of the web.

In the region of the web of woven fabric intended for the waist or lap portion of the inlay, the web may consist of single-weft or single-warp fabric in one of the three basic types of weave, that is to say in tabby (plain) weave, in twill weave, or in satin weave. However, it will be preferable to use a twill weave.

The web of fabric material may be satisfactorily finished without warp drafting (stretching), may be coated with hot sealing adhesive, and may be rolled up and unrolled. In the course of making-up of manufacturing ready-made items of clothing it will be a very easy matter to cut or stamp inlays from this web; assuming that the web of fabric material is of a suitable width, a left-hand and a right-hand reinforcing inlay can be simultaneously cut out of the web. If the reinforced regions of the web of woven fabric lie at the longitudinal edges of this web, then two reinforcing inlays, lying one beside the other, can be simultaneously cut out of the web, the respective lap portion or waist portions of these inlays lying adjacent one another in the center of the web. However, a suitably wide web of woven fabric may be cut — prior to the reinforcing inlay being cut out or stamped out — into two part-webs along the longitudinal center of the web.

The invention will be further described with reference to the accompanying drawings, which illustrate various embodiments of the invention, which are given by way of example only and not by way of limitation.

Figure 1:
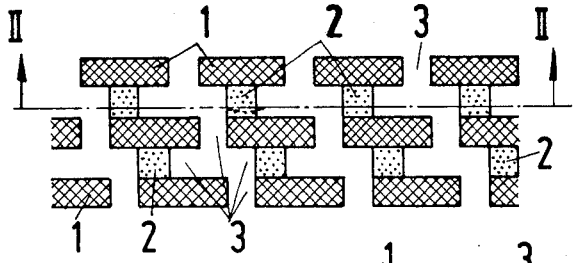
FIG. 1 shows, in diagrammatic plan view, a weave employed for the reinforcing area of a web of woven fabric.
Figure 2:
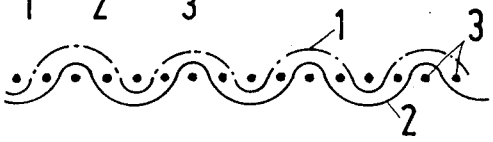
FIG. 2 is a cross-sectional view taken along II—II of FIG. 1.

The embodiment of the invention illustrated in FIGS. 1 and 2 has two different warp-thread systems 1, 2, which extend in the horizontal direction in FIG. 1, the warp threads of each system being offset, from thread to thread, by one weft thread. The warp threads of one of these thread systems, that is to say thread system 1, are represented in FIG. 1 by means of cross-hatching, in the region in which these warp threads pass over the weft threads 3, which extend perpendicularly of the warp threads. This means that the warp thread system 1 forms a 3:1 twill weave with the weft thread system; in this weave the warp threads pass over three adjacent-lying weft threads, then under a weft thread, then over three more weft threads, and so on in this order of sequence.

The threads of the second, additional warp thread system 2 are represented in FIG. 1 with dotted boxes or rectangles in those regions where they pass over weft threads. In contradistinction to the threads of the warp thread system 1, these warp threads of the warp thread system 2 define a 1 to 3 twill weave with the weft threads. This means that these warp threads initially pass over one weft thread, then under three weft threads, then over one more weft thread, and then pass under three more weft threads, and continue in this order of sequence.

Figure 3:
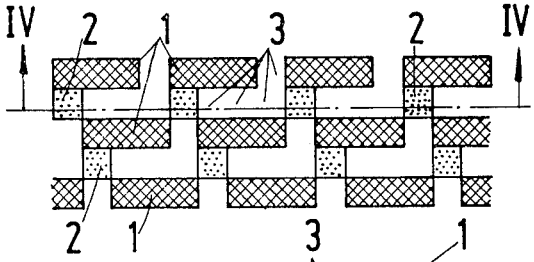
FIG. 3 is a diagrammatic plan view of a further type of weave.
Figure 4:
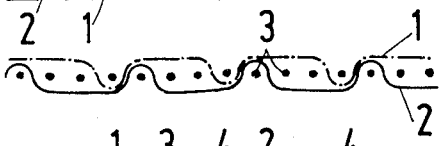
FIG. 4 is a cross-sectional view taken along line IV—IV of FIG. 3.

The embodiment of the invention illustrated in FIGS. 3 and 4, two different warp thread systems 1, 2 are again shown, these warp thread systems 1, 2 extending in the horizontal direction in FIG. 3; again, the warp threads of each system are offset, from thread to thread, by one weft thread. The warp thread system 1 defines a 3 to 1 twill weave with the weft thread system, while the additional warp thread system 2 defines a 1 to 3 twill weave with the weft thread system, as is also true in the case of the embodiment illustrated in FIGS. 1 and 2. Thus, it will be seen that the embodiment shown in FIGS. 3 and 4 differs from that shown in FIGS. 1 and 2 merely in the fact that the twill weave of the warp thread system 2 is offset, relative to the twill weave of warp thread system 1, by a distance of a single weft thread.

Figure 5:
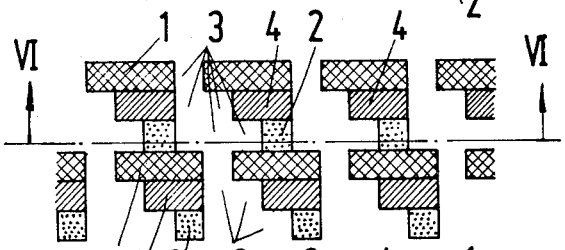
FIG. 5 is a diagrammatic plan view of a third type of weave.
Figure 6:
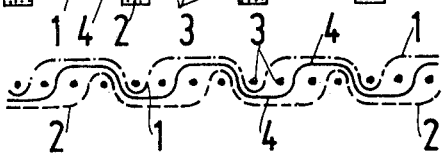
FIG. 6 is a cross-sectional view taken along line VI—VI of FIG. 5.

In the embodiment of the invention shown in FIGS. 5 and 6 three different warp thread systems 1, 2, 4 are provided, that is to say there are two separate, additional warp thread systems 2, 4 in addition to a conventional (usual) warp thread system 1. In this embodiment, again, the warp threads of system 1 are shown with cross-hatching (FIG. 5) in those areas in which they extend over the weft threads 3, while the warp threads of system 2 are indicated by means of dotted boxes or rectangles in those regions in which they extend above the weft threads. In contradistinction to this, the warp threads of the additional system 4 are designated by means of boxes marked with simple (uncrossed) hatching in those areas in which these warp threads lie above the weft threads.

The threads of the warp thread system 1 define a 3 to 1 twill weave with the weft threads, while the warp threads of the warp thread system 2 define a 1 to 3 twill weave with the weft threads. In contrast, the threads of the additional warp thread system 4 define a 2 to 2 twill weave with the weft threads. This means that the latter-mentioned warp threads 4 first of all extend over two weft threads 3, then under two weft threads, then once again over two weft threads, and so on in this pattern or sequence.

Naturally, it will be possible to combine a plurality of the three different embodiments, illustrated in FIGS. 1 to 6, in a single web of woven fabric. Thus, the weave illustrated in FIGS. 1 and 2, or in FIGS. 3 and 4, may be present in the region of the web of woven fabric from which the chest areas of the reinforcing inlays 7 are cut, while the type of weave illustrated in FIGS. 5 and 6 may be present in the region of the web of fabric material in which the shoulder portions of the reinforcing inlays to be cut are present.

However, it would also be possible to locate, in the region of the web of woven fabric containing the shoulder portions, the same type of weave as in the portion of the web of fabric material containing the chest portion of the reinforcing inlays; the additional, special warp thread system 2 may consist of a material having a particularly pronounced elasticity or resilience.

Figure 7:
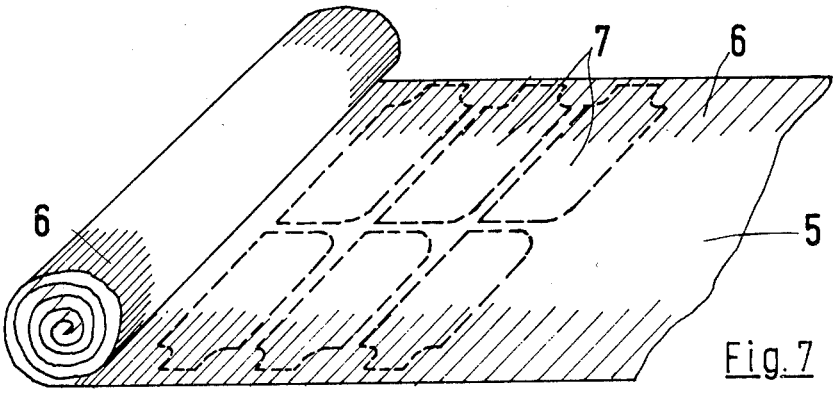
FIG. 7 is a perspective view of a web of woven fabric constituting an embodiment of the invention, incisions being shown along which reinforcing inlays may be cut out of the web.

FIG. 7 illustrates a web of woven fabric 5 according to the invention, which is of a width such that two reinforcing inlays can be cut at a time from this web 5, these reinforcing inlays 7 lying one beside the other in the direction transversely of the length of the web of woven fabric, the longitudinal direction of extent of these reinforcing inlays 7 also lying transversely of the extent of the web of woven fabric 5 itself. Under these circumstances the portions 6 of the web 5 which are reinforced with the additional warp thread system lie at the two longitudinal edges of the web 5 of woven fabric, with the result that the reinforcing inlays 7 have to be cut out of the web 5 of woven fabric with their lap or waist portions lying adjacent one another. However, it would also be possible to locate the reinforced portion 6 of the web of woven fabric in the center of this web. In that case the reinforcing inlays will have to be cut out of the web with their shoulder regions lying adjacent one another.

I claim as my invention:

1. A web of woven fabric material for use in producing reinforcing inlays for items of clothing comprising:

a. a longitudinal extending web having a weft thread system and a first warp thread system forming a twill weave of first predetermined ratio, a width of said web being at least as large as the length of a reinforcing inlay area outlined on said web; and b. a second warp thread system for reinforcement formed along the entire longitudinal extent of said web and transversely over a substantial portion of the width of said web, each thread of said first warp system being adjacent a thread of said second warp system, the twill weave of said second system having a twill weave ratio which is the inverse of said first ratio, symmetrical construction being formed about the center plane of the web.

2. The web of claim 1 in which two of said second warp thread systems are formed and the entire longitudinal extent of said web, one along each longitudinal edge of said web, a central portion of said web being unreinforced, dual inlay areas being formed transversely of said web, each area having an outer stiff portion and inner resilient portion.

3. The web of claim 1 in which a third warp thread system for reinforcement is combined with said first and second warp thread systems, said third warp thread system being symmetrical about the center plane of the web.

4. The web of claim 1 in which said second warp thread system is centered along a longitudinal central portion of said longitudinal extendng web.

5. The web of claim 1 in which individual dots formed of low melting point thermoplastic adhesive are provided on one face of said logitudinal extending web.

* * * * *